United States Patent [19]

Dixon

[11] 4,126,008

[45] Nov. 21, 1978

[54] SEA-FLOOR TEMPLATE

[75] Inventor: David A. Dixon, Palatine, Ill.

[73] Assignee: Standard Oil Company (Indiana), Chicago, Ill.

[21] Appl. No.: 830,221

[22] Filed: Sep. 2, 1977

[51] Int. Cl.[2] ..... E02B 17/02

[52] U.S. Cl. ..... 405/207; 166/366; 175/7; 405/227

[58] Field of Search ..... 61/87, 88, 89, 94, 95, 61/98; 114/264; 166/366; 175/7

[56] References Cited

U.S. PATENT DOCUMENTS

| | | | |
|---|---|---|---|
| 2,772,539 | 12/1956 | Sandberg | 61/95 |
| 3,934,658 | 1/1976 | Nelson | 175/7 |
| 4,000,624 | 1/1977 | Chow | 61/88 |

FOREIGN PATENT DOCUMENTS

| | | | |
|---|---|---|---|
| 2,454,242 | 5/1976 | Fed. Rep. of Germany | 61/87 |

*Primary Examiner*—Mervin Stein
*Assistant Examiner*—David H. Corbin
*Attorney, Agent, or Firm*—John D. Gassett

[57] ABSTRACT

A folding sea-floor compactable template for proper positioning and spacing of subsea piles and wells in the sea floor. Anchor pile templates or well templates are provided at the end of long hinged arms which extend radially out from a central section (which may also be used as a well template). The arms are folded back over the central section for transportation. Flotation can be in the main central section. With additional flotation at the outer ends of the arms, installation can be carried out by controlled submergence in stages from a single barge.

8 Claims, 7 Drawing Figures

SEA-FLOOR TEMPLATE

BACKGROUND OF THE INVENTION

1. Field of the Invention

This invention relates to a sea-floor template for the drilling of boreholes, either for anchor piling or wells in the ocean floor. It relates especially to a floating template that has folding arms for ease of transportation and installation.

In recent years there has been considerable attention attracted to the drilling and production of wells located in water. Wells may be drilled in the ocean floor from either fixed platforms in relatively shallow water or from floating structures and vessels in deep water. The most common means of anchoring fixed platforms includes the driving or otherwise anchoring of long piles in the ocean floor. Such piles normally extend above the surface of the water and support a platform attached to the top of the piles. This works fairly well in shallow water, but as the water gets deeper the problems of design and accompanying cost become prohibitive. In deeper water, it will become common practice to drill and produce from a floating structure.

In recent years there has been considerable attention directed toward many different kinds of floating structures. One system receiving attention is the so-called Vertically Moored Platform. Such a platform is described in U.S. Pat. No. 3,648,638, issued Mar. 14, 1972, Kenneth A. Blenkarn, inventor. A chief feature of the disclosure in that patent is that the floating platform is connected to an anchor only by elongated parallel members and the floating structure has buoyancy means designed especially with respect to the trough of a design wave so as to minimize variations in vertical forces imposed on the vertical elongated members which may be caused by passing waves. There are other types of floating drilling structures, such as the semi-submersible and the floating drill ship with a moon-pool or vertical opening through the center through which drilling operations are carried out. The drilling engineer selects a floating vessel which he believes will best fit the environmental conditions which are expected to be encountered.

2. Prior Art

The closest prior art relating to my invention, to the best of my knowledge, concerns templates or frames on the ocean floor having vertical passages through which wells may be drilled. The prior art template is fabricated in a fabrication yard and is a fixed structure. It is transported to a well site at the selected marine location and lowered to the sea floor. None of the prior art of which I am aware has a template with folding arms which is floated to a well site and then lowered with the arms being extended at the well site.

BRIEF DESCRIPTION OF THE INVENTION

This concerns a tranportable folding template for use as a guide in drilling boreholes or in driving piles in a sea floor. It has long extendable arms which are hingedly connected to a central base section. During transportation, the arms are folded back upon the central section to form a compacted template. The extremities of the arms are provided with guidance slots through which boreholes can be drilled or piles driven. The central section preferably has, but is not essential, well slots therein through which wellbores can be drilled.

The central section has flotation built therein preferably of sufficient magnitude to support the entire template with the arms folded on top of the central section above the water. When the template is to be used, it is towed to the selected location with the arms folded back on the center section. The template is then lowered to the ocean floor and the arms unfolded to their extended position to obtain the desired extended template. This can be accomplished by flooding the flotation portion of the central section after having first tied a cable or line between each of the arms and a barge. As the template submerges, the cables tied to the ends of the arms are pulled in a direction such that as the template reaches bottom, the arms are fully extended. Flotation at the end of the folded arms permits installation to be carried out by controlled submergence in stages from a single barge.

Preferably, the template is made of a frame comprising large, e.g., 20-inch, diameter pipe. The large hollow pipe provides the buoyancy for the template and offers less resistance to towing than does large tank-like flotation compartments.

Once the template is in position on the sea floor, it is then used in any manner desired to drill boreholes through the guide slots in the template. The template then assures that the location of the boreholes drilled or piles driven at this location of the template are in proper relationship to each other.

A better understanding of the invention may be had from the following description taken in conjunction with the drawings.

DRAWINGS

DETAILED DESCRIPTION

Figure 1:
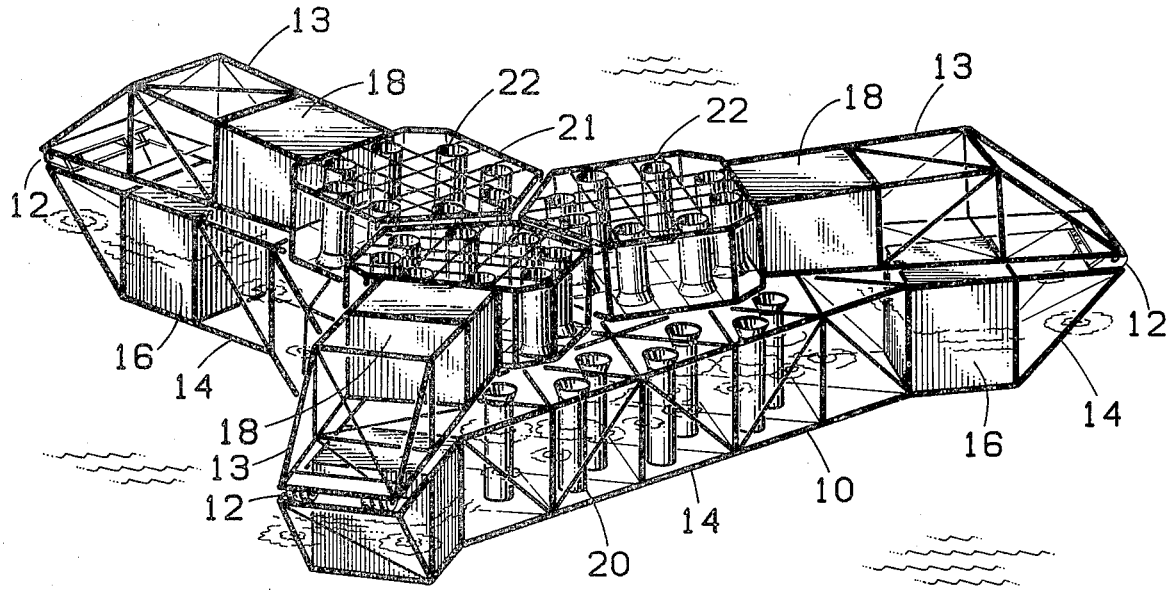
FIG. 1 illustrates a template with the arms folded into a compact size.
Figure 2:
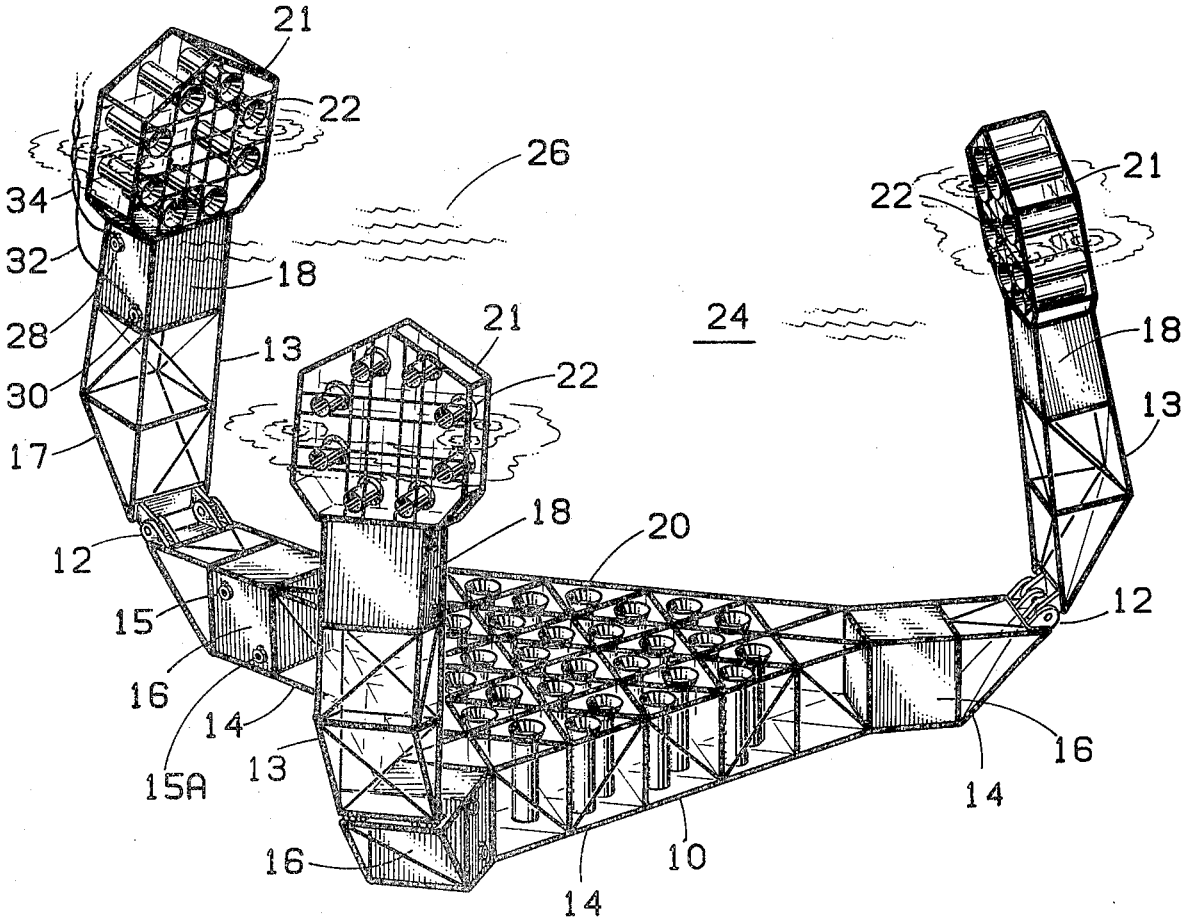
FIG. 2 shows the device of FIG. 1 in which the central portion has been ballasted and the arms are in an upright position.

Attention is now directed to the drawing and in particular to FIG. 1, which shows a compactable template in accordance with this invention in which the arms are in a folded or compact position. Shown thereon is a central base or template section 10 connected by hinge 12 to folded arms 13. The central section 10 is made of framework 14, which preferably is large diameter pipe which provides flotation to the unit. If desired, flotation compartment 16 can be added to the central unit 10 as indicated in this drawing. However, it is preferred that the flotation for the system be built into the unit 10 by having sufficiently large, hollow pipes or members 14 using no compartments. This permits easier towing than if there are bulky compartments. The particular template shown in FIGS. 1 and 2 is designed for having anchoring piling driven through slots 22 of the arm template section 21 at the extremities of the arms 13 and the production wells for oil and gas drilled through well slots 20 in the center template section 10. Placed about the arm template section 21 is a plurality of well or pile slots 22. Flotation compartments 18 can be built into arms 13 or preferably the flotation for arms 13 can be built into hollow members or pipe making up the frame.

FIG. 2 is the device of FIG. 1, except that the center template section 10 has been ballasted so as to submerge. However, in FIG. 2 the flotation elements 18 of arms 13 permit the template to still be buoyant. This permits the arms 13 to be unfolded by the buoyant forces by rotation about hinges 12 of the arms 13. Thus no large barge is required to lift the arms from their folded position shown in FIG. 1. Compartments 16 are provided with valves 15 and 15A so that the center template sections buoyant compartments 16 can be flooded. These valves are remotely controllable from the surface by any known means. It is also to be understood that valves 15 and 15A can be used to force air into the compartments to remove the water therefrom in case it is desired to lift the template. If compartments 16 are not used, valves 15 and **15*a* can, of course, be utilized with the large diameter pipe of the frame 14. Compartments 18 of arm 13 are also provided with valves 28 and 30. These are remotely controllable from the surface by any known means, such as by control lines 32 and 34, respectively. Again, if the flotation is built into the pipes 17 of the frame of the arms 13**, then the control valves can be used with such pipe.

To briefly recapitulate, it is seen then that FIG. 1 illustrates a subsea template comprising a main template section 10, which has well slots 20; arms 13, which are connected by hinges 12 to the main central template section; an arm template section 21, having well slots 22 which in this case would normally be used for anchor piling. The device in FIG. 2 shows the central template section flooded so that the buoyant arms are in an upright position lifted by its own buoyancy from its resting position of FIG. 1.

Figure 3:
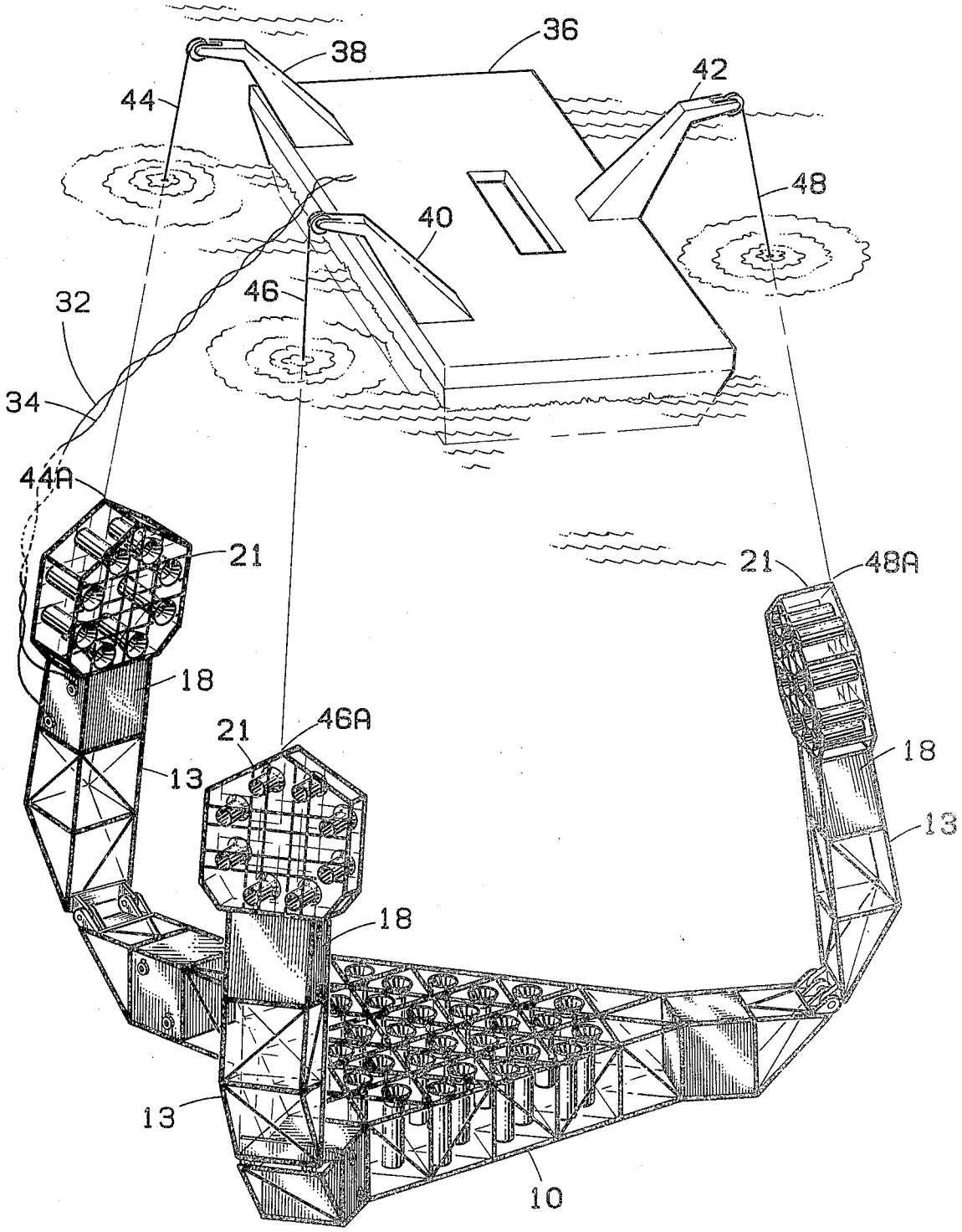
FIG. 3 is similar to FIG. 2 with the addition of a lowering barge.
Figure 4:
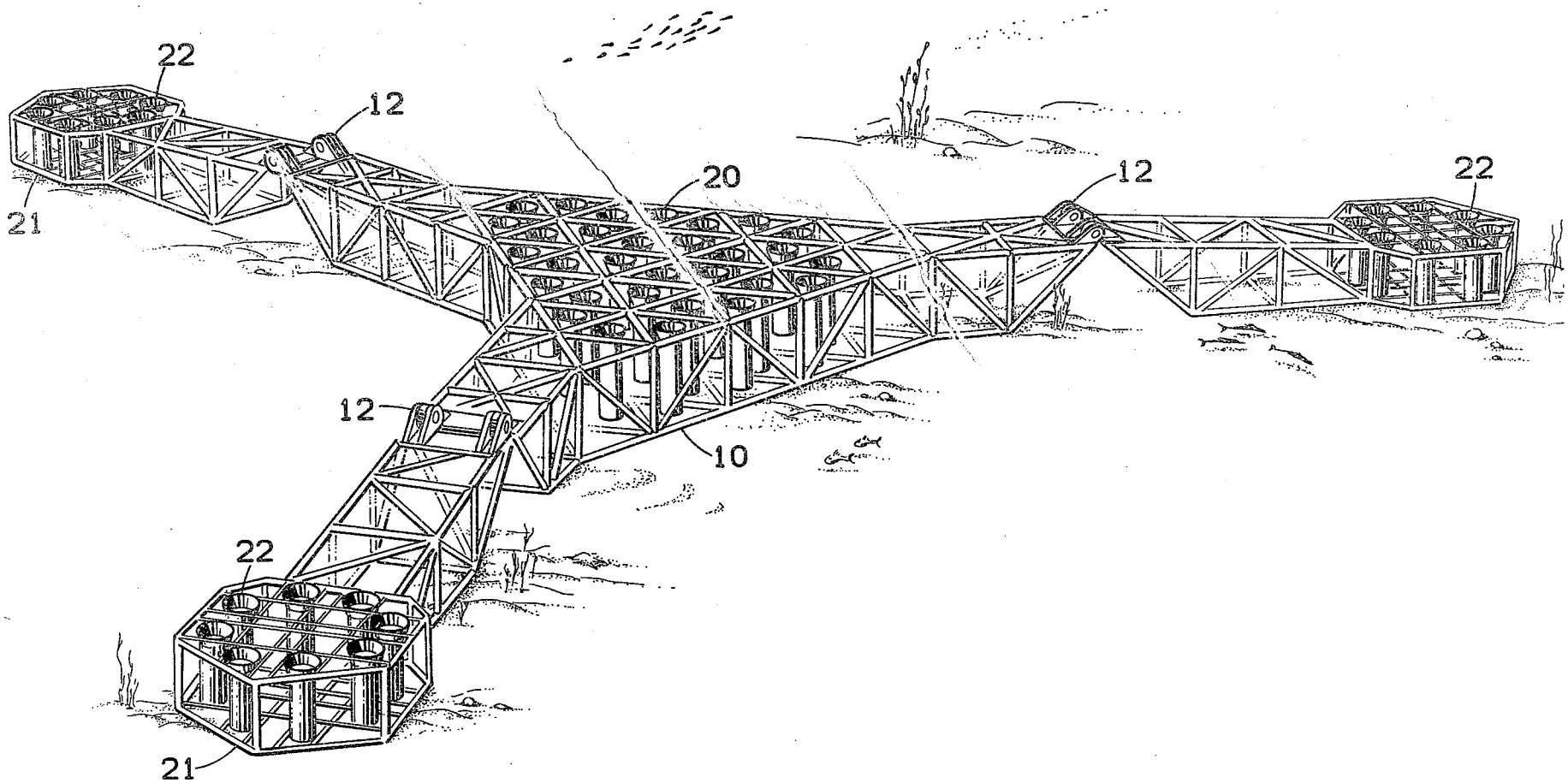
FIG. 4 illustrates an isometric view of the template of FIG. 3 in an extended position.

Attention is next directed to FIG. 3, which is quite similar to FIG. 2, except that arms 13 are now below the surface of the water and are connected to a construction barge 36 by lowering lines 44, 46, and 48 at points **44*a*, 46*a*, and 48*a* on arms 13. The upper ends of lines 44, 46, and 48 are connected to winch means 38, 40, and 42, respectively. During transportation, the arms are folded on the main center template section as shown in FIG. 1. They may be tied down in any conventional manner. When the selected location is reached, the arms 13 are disconnected from the center template 10 and then selected members in the center template section are flooded, as shown in FIG. 2, so that the center portion of the template begins to submerge. As it submerges, the arms are raised by their buoyancy to extend to a vertical position, as illustrated in FIGS. 2 and 3. However, sufficient flotation is designed into the arm template sections 21 so that the entire assembly with the well template submerged and partially flooded still floats with the pile template penetrating the water surface. Probably before this first stage of flooding of the flotation means of center section 10 is initiated, lowering lines 44, 46, 48, and control lines 32, 34 would be raised from each of the arm templates including the flotation units 18 of arm template sections 21 to appropriate points on adjacent lowering barge as illustrated in FIG. 3. With the center template section 10 then submerged and the arms extending back to the water surface, the lowering barge pulls the template under the barge 36, bringing the lowering lines up snug at three points located off the sides of the barge, as illustrated in FIG. 3. From this position then additional members of the template including flotation units 18 of arm template sections 21 are flooded. Only enough members are flooded to provide a submerged weight which is within the capacity of the lowering system. With the template then held securely by the barge with the arms folded in toward the barge, as illustrated in FIG. 3, the sub-sea template is then lowered the remaining distance to the sea floor. With the template on the sea floor oriented in position as required and leveled, if necessary, the lowering cables are pulled away from the lowering barge, keeping sufficient tension so that the arms 13 are drawn outward and then fall to the sea floor under their submerged weight. This last-mentioned step is conveniently accomplished by the use of a separate boat pulling on a line wrapped around each lowering line one at a time. As the boat draws the lowering lines 44, 46, and 48 away from the barge, the lines are let out to permit the arm at each corner to fall to the sea floor in extended position, as illustrated in FIG. 4**. After each of the three corners have been extended, it is normally advisable to use a system of subsurface surveying to insure that the arms are extended as desired. After this, a soft tag line can be run to each corner and the respective lowering line snapped and retrieved in known manners.

Figure 5:
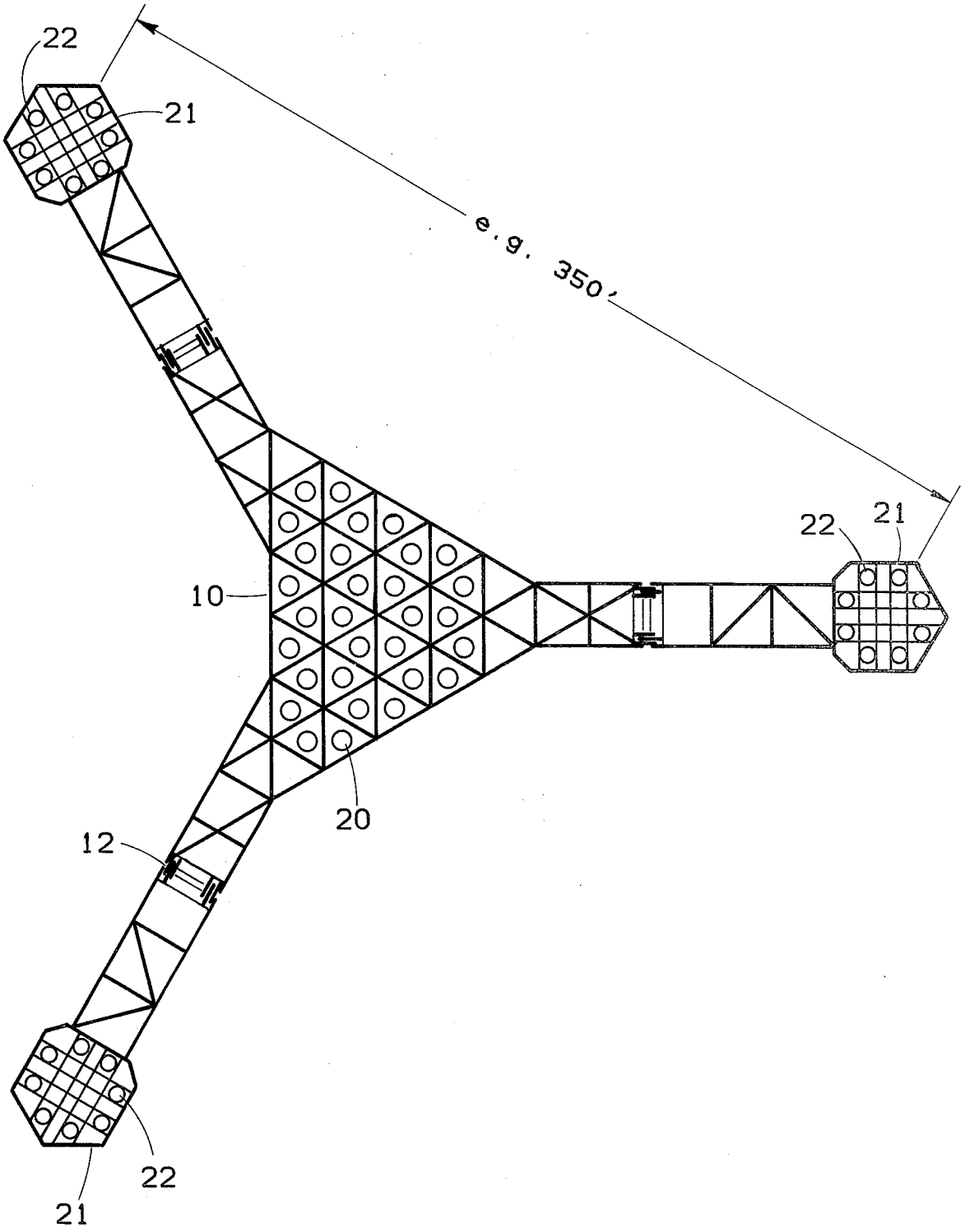
FIG. 5 illustrates a plan view of an extended compactable template in which the flotation is large diameter pipe used to make up the frame of the template.

FIG. 5 is a plan view of the extended template in place. It will be noted that the template of FIG. 5 has been slightly modified so that there are no flotation compartments shown, such as compartments 16 and 18, illustrated in FIGS. 1 and 2. The flotation then would be obtained from large size, hollow frame members which may be pipe of 20 to 30 inches in diameter, for example. The template can, of course, be sized to meet any desired need. Typically, the arm template sections 21 can be 350 feet apart as indicated in FIG. 5.

The dimensions of the well slots 20 in center template section 10 can be typically about 40 to 60 inches in diameter and 4 to 15 feet in height and are preferably flared at the top to facilitate the stabbing or guiding in of pipe or piles.

Figure 6:
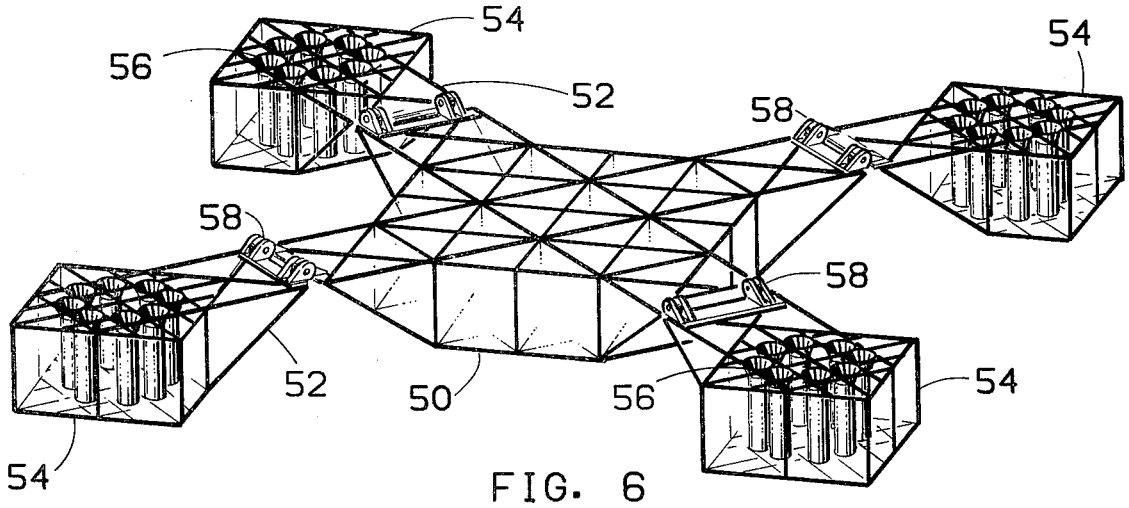
FIG. 6 illustrates a template having four arms extended to define a rectangular position.
Figure 7:
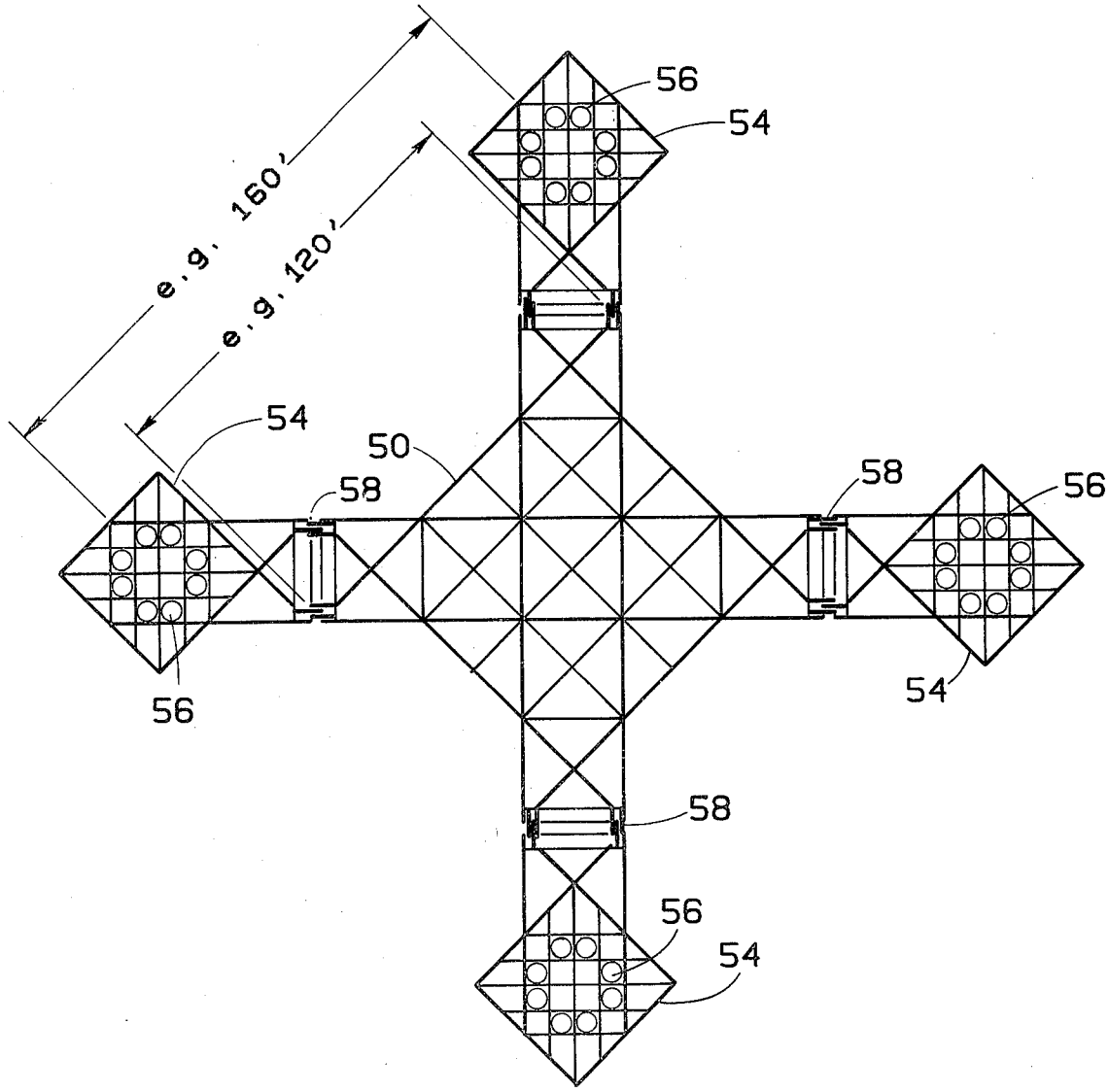
FIG. 7 is a plan view of the template of FIG. 6.

While FIGS. 1 through 5 illustrate a folding template with three foldable and extendable arms, the principle can be used to any practically desired configuration of arms and well slots. For example, see FIGS. 6 and 7, which show a four-arm sea floor template in which only the arm template sections have well slots therein. Shown in FIG. 6 is a central frame 50 and extended arms 52 having arm templates 54 and a pattern of well slots 56. These well slots 56 can be similar to well slots 22 of FIG. 1, for example. These arms ae all foldable about hinges 58. Typically, hinges 58 (and 12) can be fabricated of steel by simple means available in the fabrication yard because the strength and hinging functions are only required for the early stages of tranportation and installation. The template arrangement of FIGS. 6 and 7 is especially suitable for use with a Vertically Moored Platform, such as described in said U.S. Pat. No. 3,648,638. Typical dimensions are shown in FIG. 7, which show the center-to-center distance between arm template sections 54 could be typically about 160 feet and the length of one side of the center template 50 could be about 120 feet, for example. The floating, ballasting, and submerging of the template of FIGS. 6 and 7 would be accomplished similar to that described above for FIGS. 1 to 5.

The template can be fabricated of the same materials (i.e., steel) as conventional fixed platforms and care would be required to provide suitable cathodic protection for the entire life of the subsea template, such as by distribution of sacrificial anodes over the template, for example.

While the above descriptions have been in detail, it is possible to make various modifications to the invention described above without departing from the spirit or scope thereof.

What is claimed is:

1. A subsea template for locating boreholes in the sea bottom of a body of water which comprises:

a center base section;

arm means with an arm template at the outer end of each such arm means, said arm means and said arm template rigidly connected, said arm template section having vertical guide slots therethrough;

hinge means connecting the ends of the arm means opposite said arm template section to said center base section, whereby said arms can be folded back with said arm template over said center base section in a first position and can be unfolded to a second position to extend essentially horizontal away from said center base section;

flotation means for supporting said center base section and said arm means.

2. A subsea template as described in claim 1, in which said center base section has center base flotation sufficient to support both said base section and said arms means.

3. A subsea template as defined in claim 2, including flotation means incorporated in said arm means sufficient to support said central base section and said arms in said body of water.

4. A subsea template as defined in claim 3, including vertical well slots through said center base section.

5. A subsea template as defined in claim 4, including remotely controlled means for ballasting or deballasting said flotation means of said center base section and of said arms means.

6. A method of lowering a subsea template to the floor of a body of water from a barge in which the subsea template includes a center base section having a flotation unit, arms hingedly connected to said base section, and arms flotation means which comprises:

connecting a lowering line to each arm;

flooding said center base section flotation unit with water to lift said outer ends of said arms from said center base section as it submerges in said body of water;

deballasting said arms flotation means and lowering said sub-sea template to said floor while holding said lowering lines taut; and pulling horizontally on each said line and in a direction away from said center base section and then slackening each said line to allow the arms to drop to the sea floor in an extended position.

7. A subsea template as defined in claim 1 in which the vertical dimension of said center base section is approximately the same as that of the vertical dimension of said arm template and less than the depth of water.

8. A method of towing and lowering a subsea template to the floor of a body of water from a barge in which the subsea template includes a center base section having a flotation unit, arms hingedly connected to said base section, and arms flotation means which comprises:

folding said arms over said center base section to form a folded template;

towing said folded template on said body of water to a selected site;

connecting a lowering line to each said arm;

flooding said center base section flotation unit with water to lift said outer end of said arms from said center base section as said center base section submerges in said body of water;

deballasting said arms flotation means and lowering said subsea template to said floor while holding said lowering lines taut; and pulling horizontally on each said line in a direction away from said center base section and then slackening each said line to allow the arms to drop to the sea floor in an extended position.

* * * * *